United States Patent [19]

Koitabashi et al.

[11] Patent Number: 4,477,560

[45] Date of Patent: Oct. 16, 1984

[54] LIGHT-SENSITIVE SILVER HALIDE COLOR PHOTOGRAPHIC MATERIAL

[75] Inventors: Takeo Koitabashi; Kiyoshi Yamashita; Toshifumi Iijima, all of Hino, Japan

[73] Assignee: Konishiroku Photo Industry Co., Ltd., Tokyo, Japan

[21] Appl. No.: 449,371

[22] Filed: Dec. 13, 1982

[30] Foreign Application Priority Data

Dec. 16, 1981 [JP] Japan ..... 56-203175

[51] Int. Cl.[3] ..... G03C 1/46

[52] U.S. Cl. ..... 430/506; 430/509; 430/553; 430/555; 430/557; 430/558

[58] Field of Search ..... 430/506, 508, 509, 553, 430/555, 557, 558

[56] References Cited

U.S. PATENT DOCUMENTS

| | | | |
|---|---|---|---|
| 3,811,890 | 5/1974 | Ohta et al. | 430/509 |
| 4,170,479 | 10/1979 | Usami | 430/509 |
| 4,258,117 | 3/1981 | Morgan et al. | 430/506 |
| 4,283,472 | 8/1981 | Gompf et al. | 430/17 |
| 4,310,618 | 1/1982 | Fernandez | 430/381 |

FOREIGN PATENT DOCUMENTS 923045 4/1963 United Kingdom .

*Primary Examiner*—J. Travis Brown

*Attorney, Agent, or Firm*—Frishauf, Holtz, Goodman & Woodward

[57] ABSTRACT

There is disclosed a light-sensitive silver halide color photographic material, comprising a group of silver halide emulsion layers constituting the same color sensitive layer, said group of emulsion layers consisting of at least two silver halide emulsion layers with different light sensitivities, the layer with the highest sensitivity incorporating at least one kind of a compound having a non-diffusion type coupler component and a scavenger component for an oxidized product of a color forming developing agent in an amount of 1 to 5 mole % per mole of the silver halide in the layer containing said compound.

The light-sensitive silver halide color photographic material according to the present invention has high sensitivity and can provide high image quality with a broad latitude.

10 Claims, No Drawings

LIGHT-SENSITIVE SILVER HALIDE COLOR PHOTOGRAPHIC MATERIAL

This invention relates to a light-sensitive silver halide color photographic material (hereinafter abbreviated as color sensitive material) having a high sensitivity with broad photographic latitude and providing a high image quality.

In color sensitive materials, there have been generally attempted improvements to higher latitude and higher sensitivity in order to alleviate restrictions with respect to photographing conditions. The sensitivity of a silver halide grain is higher as the grain size is greater, while on the other hand a color image formed from a silver halide emulsion with greater grain size is deteriorated in graininess as compared with a color image formed from a silver halide emulsion equal in silver quantity to the aforesaid emulsion with smaller grain size.

As a technique to obtain a sensitive material having a high sensitivity with broad latitude without deterioration of graininess, U.K. Pat. No. 923,045 discloses a technique in which two or more emulsion layers with different sensitivities sensitive to the same wavelength region of visible light are provided and the maximum density obtained in the layer with the highest sensitivity is made 0.2 to 0.6. According to the technique described in the U.K. Pat. No. 923,045, as compared with the case where only one layer sensitive to the same wavelength region of visible light is provided or the case as described in U.S. Pat. No. 3,663,228 where no limitation is imposed on the highest density obtained in a highly sensitive layer, a color sensitive material excellent in graininess can be obtained at the same level of sensitivity, while a color sensitive material with higher sensitivity can be obtained at equal setting of graininess. As the specific methods for controlling the highest density in the most sensitive layer within said density range disclosed in U.K. Pat. No. 923,045, there are mentioned a method in which the proportion of a coupler relative to a silver halide in the most sensitive layer is made lower than in less sensitive layer, a method in which there is employed in the layer with higher sensitivity a compound not forming a dye through reaction with an oxidized product of a developing agent (hereinafter referred to as Dp' scavenger) together with a coupler, and a method in which there is employed in the high sensitivity layer a coupler having lower reactivity with an oxidized product of a developing agent.

However, in case of employing a method wherein the coupler concentration relative to silver halide is lowered in a high sensitivity layer as compared with lower sensitivity layer or a method wherein a coupler with lower reactivity is used, the oxidized product of a color forming developing agent formed by color forming development within a high sensitivity layer cannot completely be consumed in the high sensitivity layer, but the excessive oxidized product of the developing agent may cause within the high sensitivity layer oxidation of instable latent images, lowering of graininess or deterioration of sharpness due to elongated diffusion distance. Such an oxidized product may also be disadvantageously diffused into other layers to form color turbidity (when diffused into layers with different color sensitivity) or deteriorate graininess or sharpness. On the other hand, when the amount of the silver halide is reduced in order to suppress formation of an oxidized product of a developing agent, a disadvantage of lowering in sensitivity is brought about. Alternatively, when there is employed in combination a Dp' scavenger to deactivate the oxidized product of a developing agent, the maximum density is not lowered due to the presence of a large amount of the oxidized product of a developing agent at the region of higher exposure dosage, but at the region of lower exposure dosage the coupler and the Dp' scavenger will react competitively with the oxidized product of the developing agent, whereby sensitivity is lowered.

As the method to eliminate the influence of an oxidized product of a developing agent not consumed in a high sensitivity layer, while avoiding the above phenomena antagonistic to each other, it has been proposed to provide an intermediate layer between a higher sensitivity layer and a lower sensitivity layer in one kind of color sensitive layer or between a high sensitivity layer in a color sensitive layer and another color sensitive layer and incorporate a Dp' scavenger in said intermediate layer. Although the effect obtained may be greater with the increase of the layer thickness of said intermediate layer, the sharpness of a photosensitive layer lower than said intermediate layer is deteriorated in proportion to said layer thickness.

Accordingly, the first object of the present invention is to provide a novel silver halide color sensitive material having high sensitivity and providing high image quality with a broad latitude.

The second object of the present invention is to provide a silver halide color sensitive material, comprising two or more emulsions with different sensitivities having light-sensitivity in the same wavelength region of visible light, in which deterioration of sharpness by the influence of higher sensitivity layer is prevented.

Other objects of the present invention will be apparent from the description given below.

The present inventors have made extensive studies along the above objects and consequently accomplished the present invention by providing a silver halide color sensitive material, comprising a group of silver halide emulsion layers constituting the same color sensitive layer, said group of emulsion layers consisting of at least two silver halide emulsion layers with different light sensitivities, the layer with the highest sensitivity incorporating at least one kind of a compound having a non-diffusion type coupler component and a scavenger component for an oxidized product of a color forming developing agent (hereinafter abbreviated as the compound according to the present invention) in an amount of 1 to 5 mole % per mole of the silver halide in the highest sensitivity layer.

The maximum density of the image formed in the layer with the highest sensitivity containing the compound according to the present invention should preferably be in the range from 0.2 to 0.6.

The maximum density of image herein mentioned refers to the maximum density of the image obtained when exposure is effected at various dosages and the developing treatment is applied as described in Reference example 1, which is measured at the maximum absorption wavelength of the image.

In the present invention, the compound according to the present invention refers to a compound having both of a non-diffusion type coupler component and a scavenger component for an oxidized product of a color forming developing agent in the molecule, including a type in which the reaction between a non-diffusion type coupler component and an oxidized product of a color forming developing agent first occurs and then the reaction product reacts as a scavenger with the oxidized product of the color forming developing agent and a type in which the reaction between a scavenger component and an oxidized product of a color forming developing agent occurs and then the reaction product reacts as a non-diffusion type coupler with the oxidized product of the color forming developing agent.

The above scavenger compound or scavenger component is one which scavenges an oxidized product of a color forming developing agent in a color sensitive material during development, typically a compound which undergoes a cross oxidation reaction with an oxidized product of a color forming developing agent to convert said oxidized product into the color forming agent and a compound which undergoes a coupling reaction with an oxidized product of a color forming agent to form a product having no deleterious effect on photographic characteristics such as a non-coloring compound or a compound which can be flown out from the color sensitive material.

The compound according to the present invention is disclosed in U.S. Pat. Nos. 4,283,472, 4,310,618, UST-101,004, U.K. Pat. No. 1,546,837, Japanese Provisional Patent Publications No. 133,734/1981, No. 11,536/1982 and No. 11,537/1982, and Research Disclosure No. 19,633, August, 1980, etc. But, there is disclosed no example as in the present invention of a light sensitive silver halide color photographic material having two or more layers of the same color sensitivity with different sensitivities, wherein 1 to 5 mole % of said compound is incorporated in the layer with the highest sensitivity of the layers, comprising two or more layers having the same color sensitivity with different sensitivities, per mole of silver halide contained in said layer.

Of the compounds according to the present invention, representative are those shown by the following formulas [I] to [IV].

Formula [I]:

```
Non-diffusion type coupler component - I
              |
             CH—R
              |
Coupler Component - I
```

In the above formula, R represents a hydrogen atom, an alkyl group or a phenyl group; Non-diffusion type coupler component-I represents a residual group of a non-diffusion type coupler capable of forming a non-diffusion type color forming dye through the coupling reaction with an oxidized product of a color forming developing agent from which coupler the hydrogen atom at the active site is eliminated; and Coupler component-I represents a residual group of a coupler capable of forming a diffusion type color forming dye or a non-coloring compound absorbing substantially no visible light, from which coupler the hydrogen atom at the active site is eliminated. Here, the Coupler component-I corresponds to the scavenger component as mentioned above.

The compound represented by the formula [I] reacts first, at the component with greater reactivity with an oxidized product of a color forming developing agent of the Non-diffusion type coupler component-I and the Coupler component-I, with said oxidized product, whereby the linkage between said component and CH—R is cleaved, and then the residual component reacts with the oxidized product of the color forming developing agent.

Formula [II]:

```
Non-diffusion type coupler component - II
              |
Coupler component - I
```

In the above formula, the Non-diffusion type coupler component-II represents a residual group of a non-diffusion type coupler, capable of forming a non-diffusion type color forming dye through the coupling reaction with an oxidized product of a color forming developing agent, from which the hydrogen atom at a non-active site is eliminated; and Coupler component-I is the same as defined in Formula [I]. Here, the Non-diffusion type coupler-II is inactive at the beginning, but it becomes active through cleavage of the linkage with the Coupler component-I when the active Coupler-I reacts with an oxidized product of a color forming developing agent. The Coupler component-I also corresponds to the scavenger component as mentioned above.

In the Formula [II], the Non-diffusion type coupler component-II should preferably be bonded through an oxygen atom or a nitrogen atom in said component to an active site of the Coupler component-I. A preferable bonding state between said oxygen atom or nitrogen atom and the carbon atom at the active site in the Non-diffusion type coupler component-II is shown below:

$$C{=}C{-}C{=}_{m}C{-}A$$

wherein C is a carbon atom at the active site, A is the oxygen atom or the nitrogen atom as mentioned above and m is 0 or 1.

Formula [III]:

```
Non-diffusion type coupler component - I
              |
Coupler component - II
```

In the above formula, the Non-diffusion type coupler component-I is the same as defined in Formula [I] and the Coupler component-II represents a residual group of a coupler, capable of forming a diffusion type color forming dye or a non-coloring compound absorbing substantially no visible light, from which the hydrogen atom at a non-active site is eliminated. Here, the Coupler Component-II is inactive at the biginning, but it becomes an active scavenger through cleavage of the linkage with the Non-diffusion type coupler component-I when the active Non-diffusion type coupler-I undergoes coupling reaction with an oxidized product of a color forming developing agent. Also, the Coupler component-II corresponds to the scavenger component as mentioned above.

In the Formula [III], the Coupler component-II should preferably be bonded through an oxygen atom or a nitrogen atom in said component to an active site of the Non-diffusion type coupler component-I. A preferable bonding state between said oxygen atom or nitrogen atom and the carbon atom at the active site in the Coupler component-II is shown below:

$$C{=}C{-}C{=}_{m}C{-}A$$

wherein C is a carbon atom at the active site, A is the oxygen atom or the nitrogen atom as mentioned above and m is 0 or 1.

Formula [IV]:

Non-diffusion coupler component - I
|
ED - component

In the above formula, the Non-diffusion type coupler component-I is the same as defined in Formula [I], and the ED-component is a residual group of a compound, capable of undergoing a cross oxidation reaction with an oxidized product of a color forming developing agent (hereinafter called as ED) from which a hydrogen atom is eliminated. Here, the ED component is first inactive, but it becomes an active scavenger ED through cleavage of the linkage with the Non-diffusion type coupler component-I when the Non-diffusion type coupler component-I undergoes coupling reaction with an oxidized product of a color forming developing agent. The ED component corresponds to the scavenger component as mentioned above.

In the formula [IV], the ED component is a residual group in which a hydrogen atom has been eliminated from the ED on its active group (e.g., an hydroxyl group, an amino group or the like) on which the ED undergoes cross oxidation reaction with an oxidized product of a color forming developing agent.

A preferable ED component has a partial structure represented by the following formula:

$$-O-(C{=}C)_n-R$$

wherein n is an integer of 1 to 4, preferably 1 or 2 and R is H, —OH, $-NH_2$, $-NHR_1$, $-NR_2R_3$ or $-NHSO_2R_4$ (where $R_1$ is an alkyl group, $R_2$ and $R_3$ are alkyl groups, or $R_2$ and $R_3$ taken together is an atomic group forming a heterocyclic group including nitrogen, and $R_4$ is an alkyl group or an aryl group.

In the above formula, when n is 1, —C=C— may represent a partial structure of a benzene ring or a naphthalene ring. When n is 2, $(C{=}C)_n$ may also represent a partial structure of a benzene ring or a naphthalene ring.

The alkyl group represented by $R_1$, $R_2$, $R_3$ or $R_4$ may be substituted with substituents such as halogen atoms, alkoxy groups and others. The alkyl group may be either straight or branched, having preferably 1 to 5 carbon atoms.

The aryl group represented by $R_4$ is also inclusive of those having substituents, as exemplified by a phenyl, an alkoxy-substituted phenyl or an alkyl-substituted phenyl group. As the heterocyclic ring including nitrogen formed by combination of $R_2$ and $R_3$ may include morpholino, piperidino, piperazino, etc.

As ED, there may preferably be employed hydroquinone type compounds, catechol type compounds, o-aminophenol type compounds and p-aminophenol type compounds.

As the Non-diffusion type coupler component-I and II in the formulae [I] through [IV], there may be employed residual groups of non-diffusion type couplers known in the art. Typical examples of said non-diffusion type couplers may include phenol type couplers, naphthol type coupler, pyrazolone type couplers, pyrazolotriazole type couplers, pyrazolobenzimidazole type couplers, indanone type couplers, open chain ketomethylene type couplers, and so on.

Also, as the Coupler component-I and II in the formulae [I] through [III], there may be employed residual groups of couplers known in the art. Said couplers may be inclusive of phenol type couplers, naphthol type coupler, pyrazolone type couplers, pyrazolotriazole type couplers, pyrazolobenzimidazole type couplers, indanone type couplers, open chain keto-methylene type couplers, and so on.

As the couplers as mentioned above, there may be included benzoyl acetanilide type yellow couplers or pivaloyl acetanilide type yellow couplers as disclosed in U.S. Pat. Nos. 2,298,443, 2,407,210, 2,875,057, 3,048,194, 3,265,506 and 3,447,928 and Mitteilungen aus den Forschungslaboratorien der Agfa (Band III, pp, 111–126, 1961) "Farbkuppler", etc.; various magenta couplers such as pyrazolone type magenta couplers, indazolone type magenta couplers, pyrazolotriazole type magenta couplers, pyrazolobenzimidazole type magenta couplers, etc. as disclosed in U.S. Pat. Nos. 2,369,489, 2,343,703, 2,311,082, 2,600,788, 2,908,573, 3,152,896 and 3,519,429 and the aforesaid Agfa Mitteilung (Band III) pp, 126–156 (1961); and naphthol type or phenol type couplers as disclosed in U.S. Pat. Nos. 2,367,531, 2,423,730, 2,474,293, 2,772,162, 2,895,826, 3,034,892 and 3,041,236 and the aforesaid Agfa Mitteilung (Band III) pp. 156–175 (1961).

Typical examples of the compounds according to the present invention are enumerated below, but the present invention is not limited thereto.

Compound No. 1

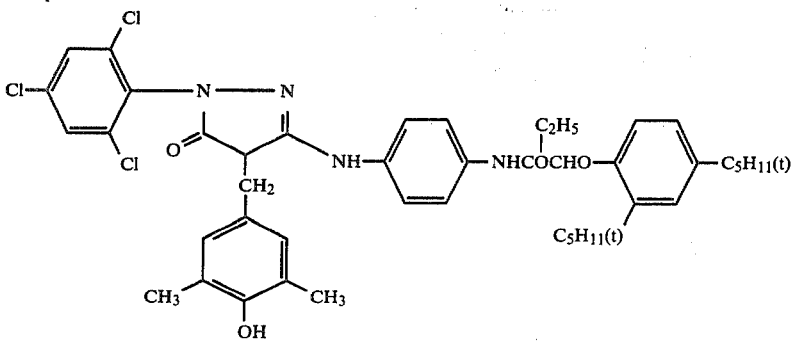

Compound No. 2

Compound No. 3

-continued
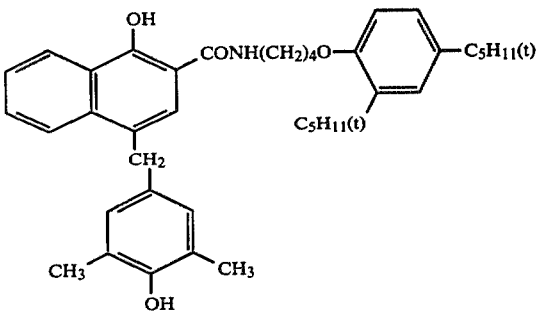
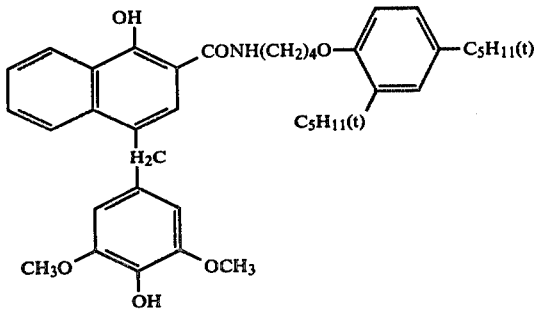
Compound No. 4
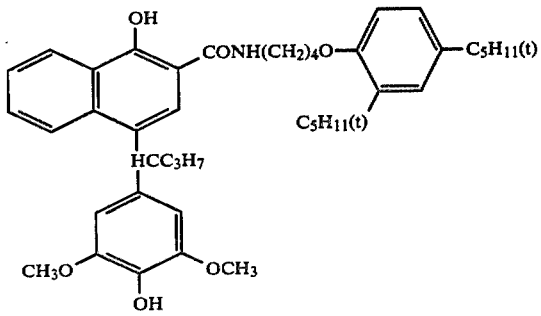
Compound No. 5
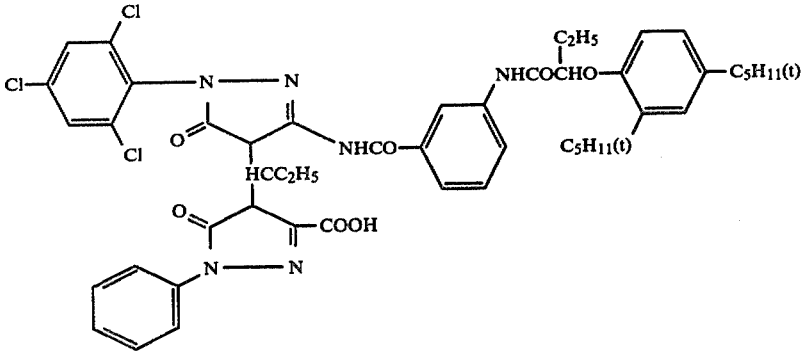
Compound No. 6
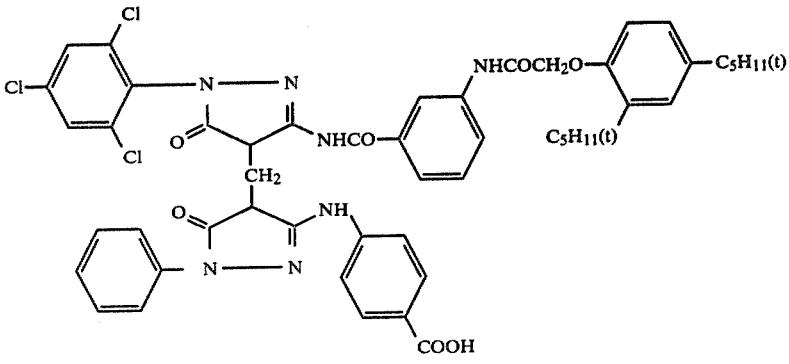
Compound No. 7

-continued
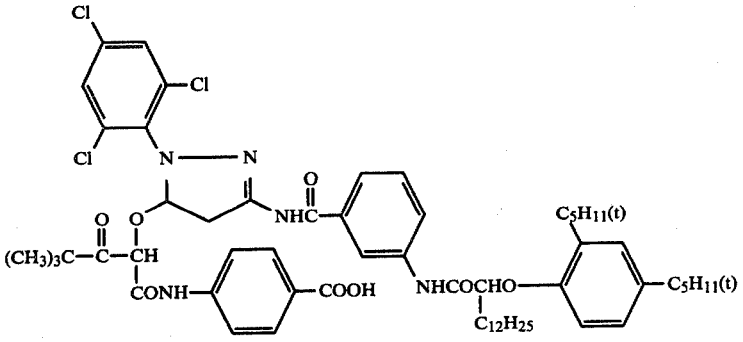
Compound No. 8
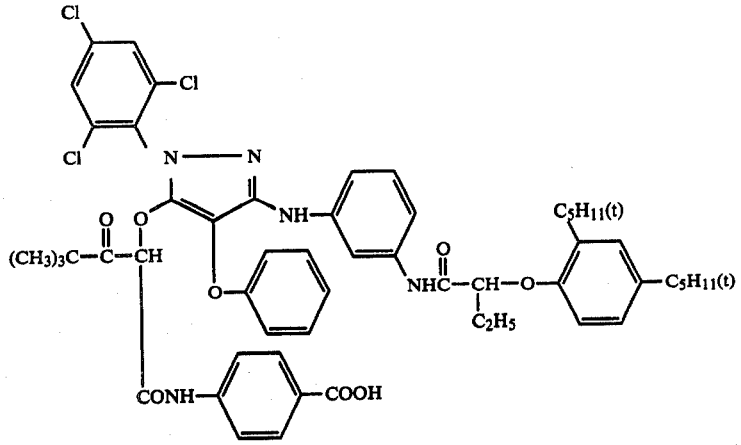
Compound No. 9
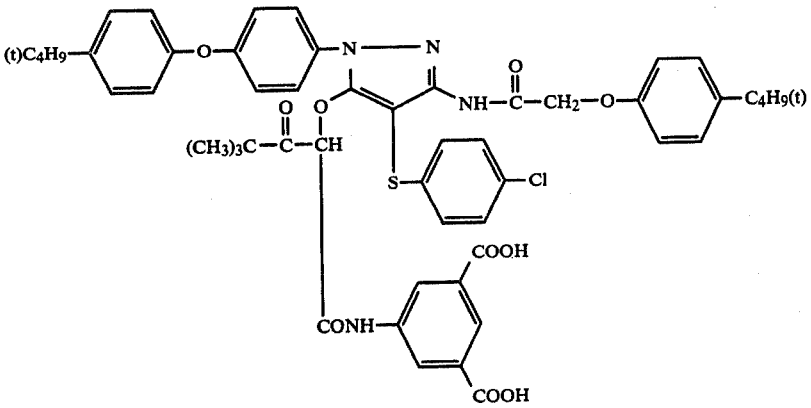
Compound No. 10

-continued
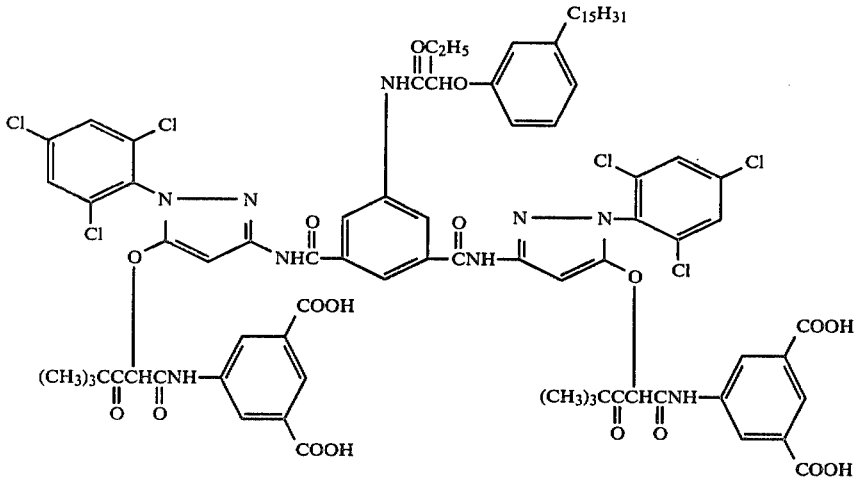
Compound No. 11
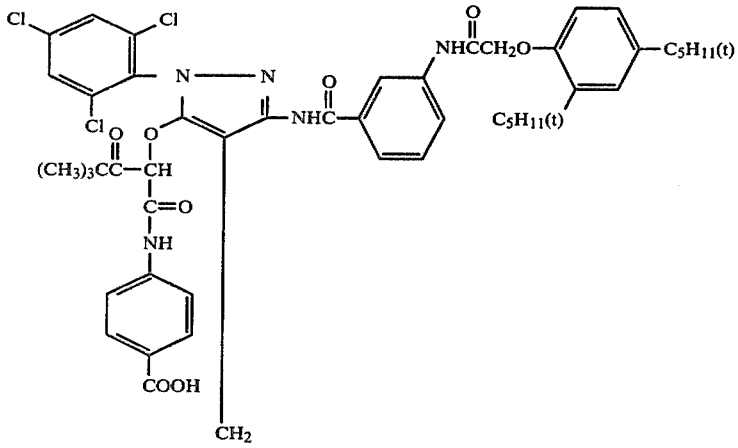
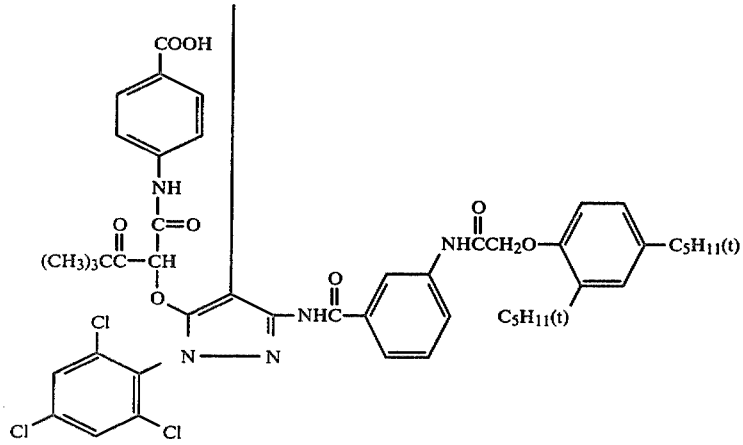
Compound No. 12
Compound No. 13

-continued
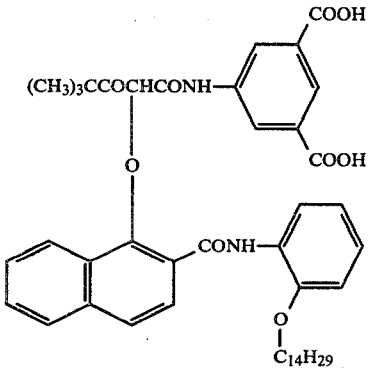
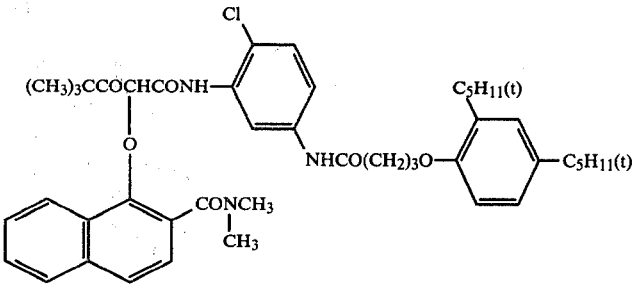
Compound No. 14
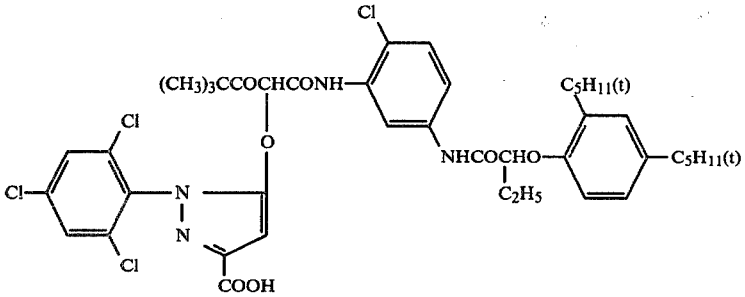
Compound No. 15
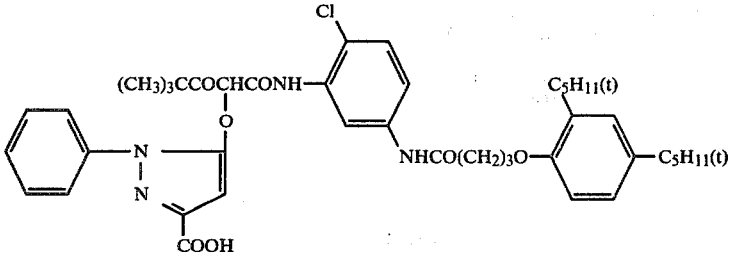
Compound No. 16
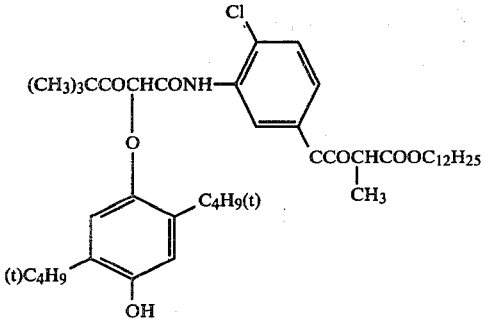
Compound No. 17
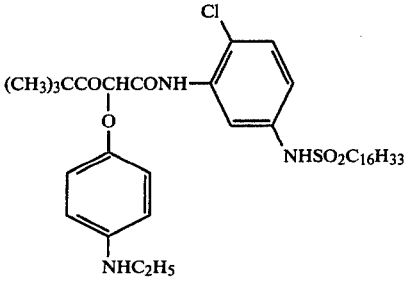
Compound No. 18
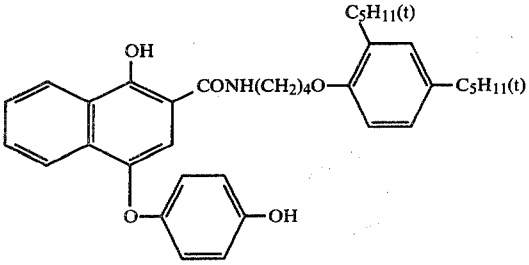
Compound No. 19
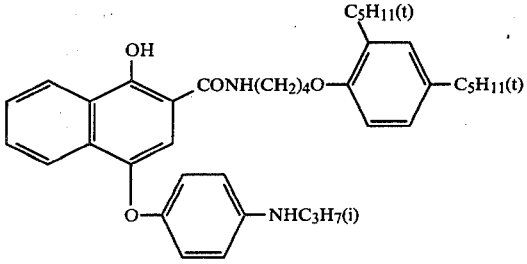
Compound No. 20

-continued
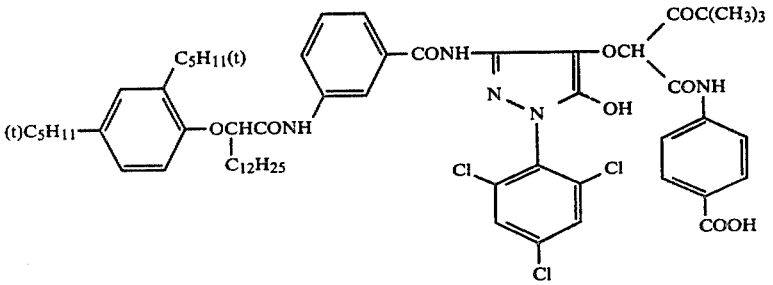
Compound No. 21
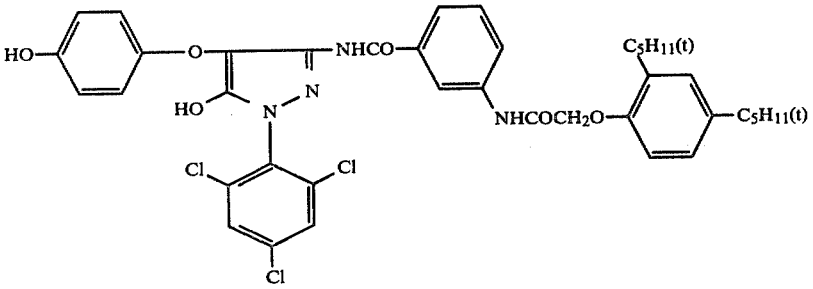
Compound No. 22
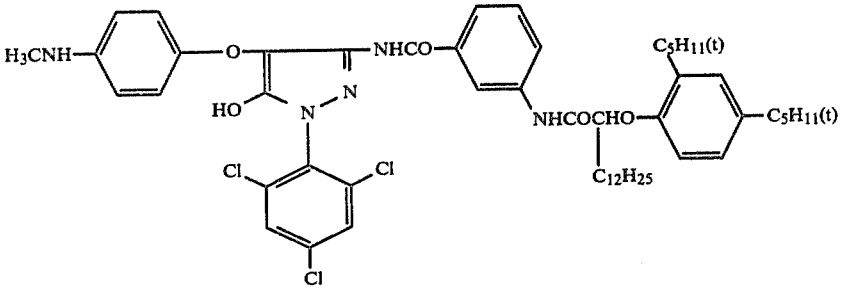
Compound No. 23
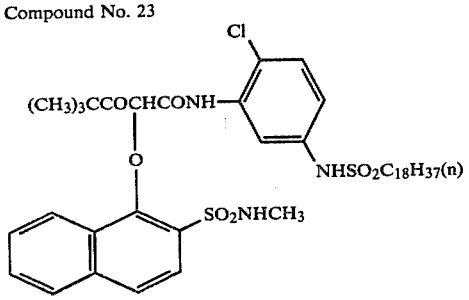
Compound No. 24
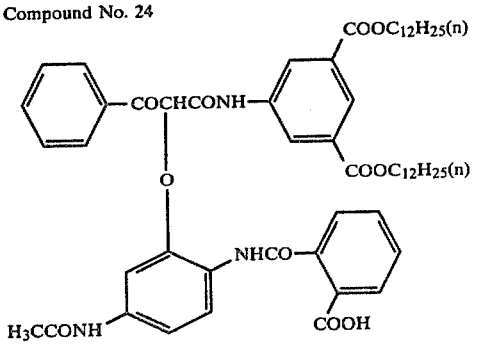
Compound No. 25
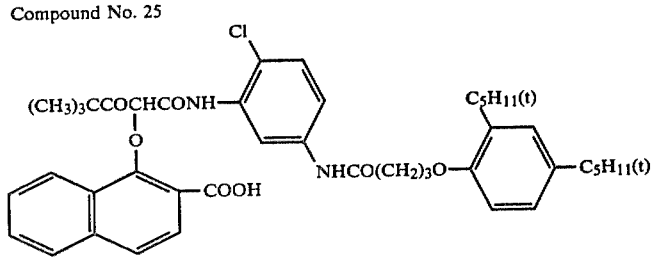
Compound No. 26
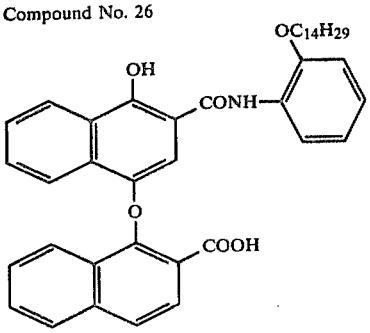
Compound No. 27

-continued
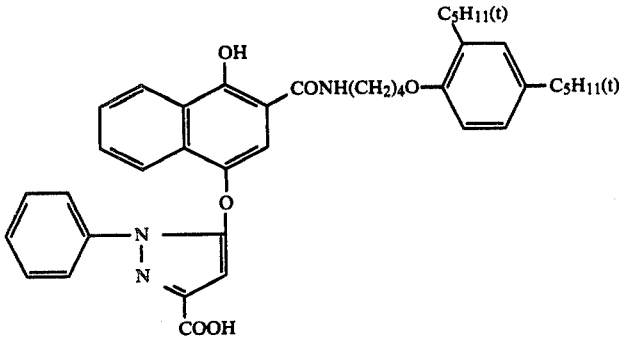
Compound No. 28
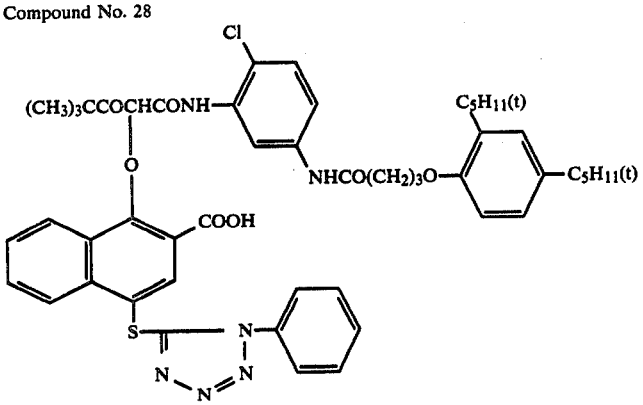
Compound No. 29
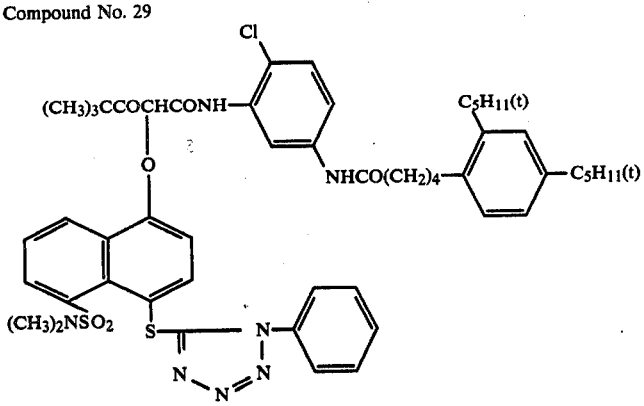
Compound No. 30
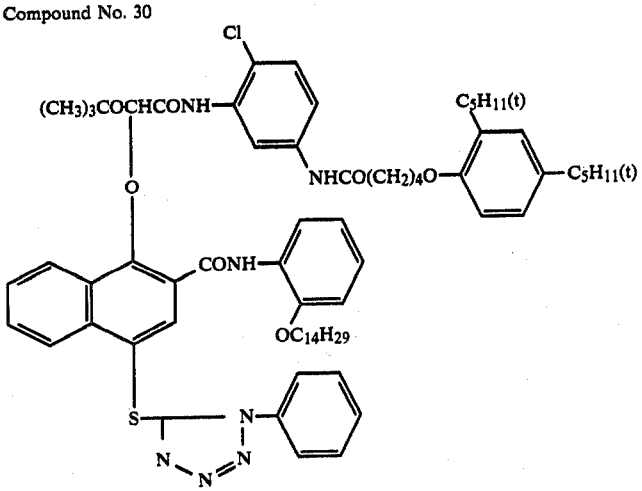
Compound No. 31
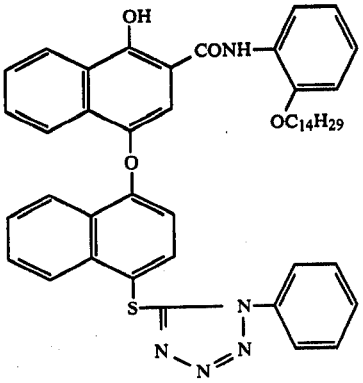
Compound No. 32

-continued

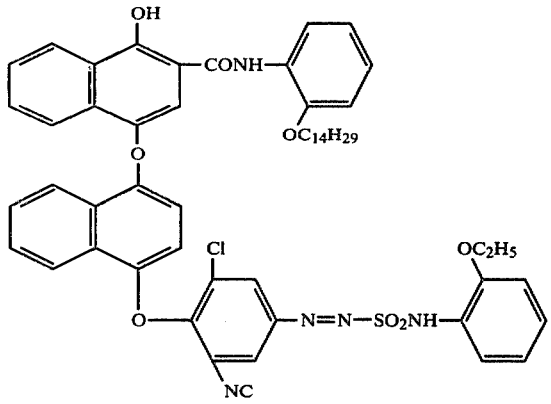

Compound No. 33

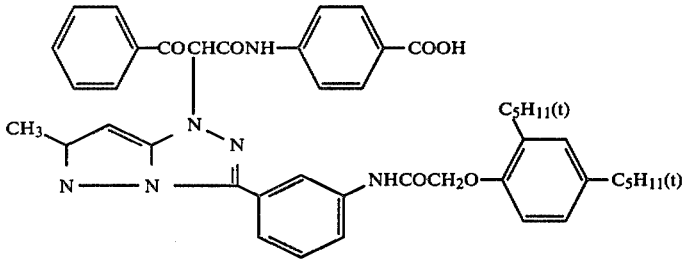

Compound No. 34

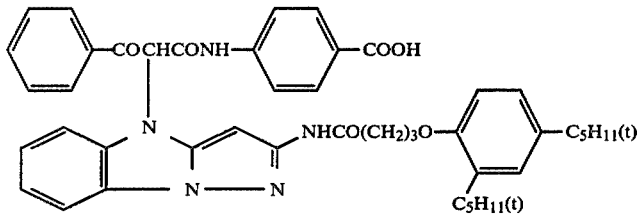

Compound No. 35

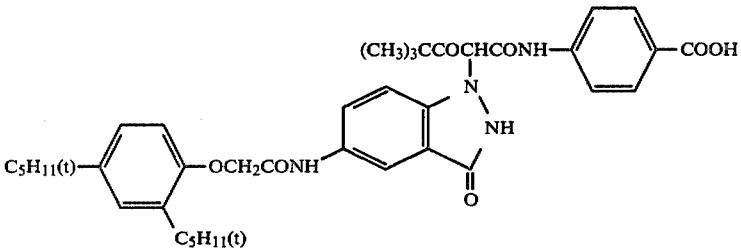

The compound according to the present invention is preferred to be of the type which will undergo the reaction with an oxidized product of a color forming developing agent first at the non-diffusion type coupler component, followed by the reaction of the resultant reaction product as a scavenger with the oxidized product of the color forming developing agent. However, the object of the present invention can also be accomplished by a compound of the type which will undergo the reaction with an oxidized product of a color forming developing agent first at the scavenger component, followed by the reaction of the resultant reaction product as a non-diffusion type coupler component with the oxidized product of the color forming developing agent.

The accomplishment cannot be expected from the combined use of a coupler and a Dp' scavenger. Probably, this may be due to the conditions set under which the non-diffusion type coupler formed from the compound according to the present invention can be more readily reactive with an oxidized product of a color forming developing agent as compared with unaltered compound of the present invention.

The effect of the present invention is obtained by the increase of the total amount of the component reactive with an oxidized product of a color forming developing agent in a layer without impairing the reaction between the non-diffusion type coupler component and the oxidized product of the color forming developing agent and also without increasing the concentration of the non-diffusion type coupler component. But it is entirely unexpected that said effect can be obtained by the compound according to the present invention. There is a compound called in this field of art as DIR coupler similar to the compound of the present invention capable of liberating a development inhibiting agent component through the reaction of a non-diffusing type coupler component and an oxidized product of a color forming developing agent. However, it is difficult to obtain a desired tone without using another coupler in combination due to the action of the development inhibiting agent liberated. Even when used in combination with another coupler, if the image density obtained in the high density layer is controlled within a desired density range, the tone obtained becomes unfavorably too flat.

In the case when the Coupler component-II represented by the formula [III] is a DIR coupler such as in the Compounds—28, 29, 30 and 31, and a DIR coupler is liberated after the active non-diffusion type component-I has undergone a coupling reaction with an oxidized product of a color forming developing agent, the effect obtained is the same as that when using other compounds of the present invention.

The high sensitivity layer containing the compound according to the present invention may be any one of the blue sensitive layer, the green sensitive layer and the red sensitive layer. However, the effect of the present invention should be exhibited in the layer where image quality receives priority, and therefore at least the highest sensitivity layer of green sensitive layer should preferably be the layer containing the compound according to the present invention.

In the highest sensitivity layer in which the compound of the present invention is to be used, it is preferred to use only the compound of the present invention as the compound which reacts with an oxidized product of a color forming developing agent to form a dye, but it is also possible to use the compound of the present invention in combination with a coupler, so far as the effect of the present invention is not inhibited thereby.

In the color sensitive material of the present invention, the color forming dye formed from said compound of the present invention and/or a combination with a coupler may be complementary relative to the color sensitivity of blue sensitive, green sensitive and red sensitive silver halide emulsion layers, as in conventional color sensitive materials. Alternatively, it may be also a combination of false colors such as a magenta coupler and a blue sensitive silver halide emulsion, a yellow coupler and a green sensitive silver halide emulsion, and a cyan coupler and a red sensitive silver halide emulsion.

Said coupler may be either tetraequivalent or diequivalent to silver ion. The form of the coupler may be either of a low molecular weight coupler or of a so called polymeric coupler.

As the yellow coupler, there may be employed open chain keto-methylene type couplers. Among them, benzoyl acetanilide type and pivaloyl acetanilide type compounds are useful.

As the magenta coupler, there may be employed pyrazolone type compounds, pyrazolotriazole type compounds, indazolone type compounds, cyanoacetyl compounds, and as the cyan coupler phenol type compounds, naphthol type compounds, etc.

The compound according to the present invention and the coupler may be incorporated in the color sensitive material according to various methods. Among them, the latex dispersing method or the oil droplet-in-water type emulsifying dispersing method is particularly useful. These dispersing methods are well known in the art, and the latex dispersing method and its effect are described in Japanese Provisional Patent Publication No. 74538/1974, No. 59943/1974 and No. 32552/1979, and Research Disclosure No. 14850, pp, 77–79, August, 1976.

The latex suitably used in the latex dispersing method may include homopolymers, copolymers and terpolymers of monomers such as styrene, ethyl acrylate, n-butyl acrylate, n-butyl methacrylate, 2-acetoacetoxyethyl methacrylate, 2-(methacryloyloxy)ethyltrimethylammonium methosulfate, sodium 3-(methacryloyloxy)propane-2-sulfonate, N-isopropylacrylamide, N-[2-(2-methyl-4-oxopentyl)]acrylamide, 2-acrylamido-2-methylpropane sulfonic acid, etc. As the oil droplet-in-water type emulsifying dispersing method, it is possible to apply the method known in the art in which a hydrophobic additive such as coupler, etc. is dispersed. The compound according to the present invention, when it is used in combination with other couplers, may be dispersed at the same time, or alternatively dispersed separately and added independently.

It is also possible to control the layer receiving the influence of a development inhibiting agent or the unit layer by interposing a single or a plurality of scavenger layers at an appropriate position between the constituent layers of the color sensitive material.

As the silver halide emulsion to be used in the color sensitive material of the present invention, any silver halide emulsion used in this field of art may be applicable. For example, it may contain crystals of silver chloride, silver bromide, silver iodobromide, silver chlorobromide, silver chloroiodide or silver chloroiodobromide or a mixture of these crystals. Said silver halide emulsion may contain either large grains or small grains and it may be either monodispersed or polydispersed. The silver halide crystals may be either cubic, octahedral or epitaxial hybrid crystals. Said emulsion may be made a nega emulsion or directly a posi emulsion. They may be used as a surface latent image type emulsion in which latent images are formed primarily on the surfaces of silver halide grains or an internal latent image type emulsion in which latent images are formed internally of the silver halide grains, or a mixture of a surface latent image type emulsion and an internal latent image type emulsion.

These silver halides may be chemically sensitized by active gelatin; sulfur sensitizers such as allyl thiocarbamide, thiourea, cystine, etc.; selenium sensitizers; reductive sensitizers such as stannous salts, thiourea dioxide, polyamines, etc.; noble metal sensitizers such as gold sensitizer, more specifically potassium aurithiocyanate, potassium chloroaurate, 2-aurosulfobenzothiazole methochloride or sensitizers of water soluble salts of ruthenium, rhodium, iridium, palladium, platinum, etc., more specifically ammonium chloropalladate, potassium chloroplatiote and sodium chloropalladite, etc (some kinds of these act as fog inhibitors depending on the amount employed); and others, either as a single species or a suitable combination (e.g. combination of a gold sensitizer with a sulfur sensitizer, combination of a gold sensitizer with a selenium sensitizer, etc.).

Further, the silver halide may be optically sensitized to a desired wavelength. For example, it may be sensitized optically by using singly or in combination (e.g. supersensitization) optical sensitizers such as cyanine dyes, including zeromethyne dyes, monomethyne dyes, dimethyne dyes and trimethyne dyes, or melocyanine dyes.

As for other specific constitutions of the color sensitive materials of the present invention, the contents disclosed in Research Disclosure No. 18431 and No. 17643 may be applicable.

The present invention is described in detail below by referring to the Examples for showing by way of illustration that high sensitivity with broad latitude as well as high image quality can be provided by use of the compound according to the present invention in the high sensitivity layer.

Detection of the improved effect of image sharpness was conducted by determining MTF (Modulation Transfer Function) and comparing the largeness of MTF at the space frequency 30/mm.

Graininess (RMS) was evaluated by comparison of 1000-fold value of the standard deviation difference of the fluctuations of the density value occurring when scanning with a microdensitometer with a circular scanning bore diameter of 25μ.

REFERENCE EXAMPLE 1

According to the following procedures, the first layer and the second layer were successively provided by coating on a support to prepare respective samples.

First Layer

As a cyan coupler, 10.6 g of 1-hydroxy-N-[4-(2,4-di-t-amylphenoxy)butyl]-2-naphthoamide [hereinafter called as cyan coupler (C-1)], and 0.6 g of α-(1-phenyl-5-tetrazolylthio)-4-octadecenylsuccinimido-1-indanone [hereinafter called as DIR compound (W-1)] were dissolved in 22.4 ml of ethyl acetate and 11.2 ml of tricresyl phosphate (hereinafter called as TCP), and the resultant solution was mixed with 20 ml of a 10% aqueous solution of Alkanol B (alkylnaphthalene sulfonate, produced by E. I. Du Pont de Nemours & Company) and 200 ml of an aqueous 5% gelatin solution, followed by emulsifying dispersing by means of a colloid mill. The dispersion was added to a low sensitivity red sensitive silver iodobromide emulsion (containing 4.0 mole % of silver iodide) to a content of the aforesaid C-1 of 10 mole % per one mole of the silver iodobromide and the mixture was coated on a triacetate base to a silver quantity of 13 mg/dm$^2$ and dried.

Second Layer

Each solution in ethyl acetate and TCP of the compounds according to the present invention and Control compounds as shown in Table 1 was mixed with 60 ml of a 10% aqueous Alkanol B solution and 600 ml of an aqueous 5% gelatin solution, followed by emulsifying dispersing by means of a colloid mill. The dispersion was added to a high sensitivity green sensitive silver iodobromide emulsion (containing 6.0 mole % of silver iodobromide) and the mixture was over-layed by coating on the aforesaid first layer to a silver quantity of 13 mg/dm$^2$. Thus, Samples 1 to 6 were prepared. The abbreviated symbol M-1 represents 1-(2,4,6-trichloro)-phenyl-3-[3-(2,4-di-t-amylphenoxy) acetamido]-benzamido-5-pyrazolone, and this symbol is hereinafter employed. The symbol D-1 represents 1-phenyl-3-heptadecyl-4-methyl-5-pyrazolone and this symbol is hereinafter employed.

TABLE 1

| (Additives to the second layer) | | |
|---|---|---|
| Sample 1 | M - 1 | 0.025 mole |
| | Ethyl acetate | 44 ml |
| | TCP | 22 ml |
| Sample 2 | M - 1 | 0.05 mole |
| | W - 1 | 0.001 mole |
| | Ethyl acetate | 105 ml |
| | TCP | 35 ml |
| Sample 3 | M - 1 | 0.05 mole |
| | D - 1 | 0.025 mole |
| | Ethyl acetate | 105 ml |
| | TCP | 35 ml |
| Sample 4 | Exemplary compound-1 | 0.03 mole |
| | Ethyl acetate | 60 ml |
| | TCP | 30 ml |
| Sample 5 | Exemplary compound-1 | 0.05 mole |
| | Ethyl acetate | 100 ml |
| | TCP | 50 ml |
| Sample 6 | Exemplary compound-1 | 0.07 mole |
| | Ethyl acetate | 140 ml |
| | TCP | 70 ml |

These samples were exposed through a wedge to a green monochromatic light and subjected to the following treatment steps at 35° C., respectively, to obtain samples having dye images.

| Treatment step | Treatment time |
|---|---|
| Color forming developing | 3 min. 15 sec. |
| Bleaching | 6 min. 30 sec. |
| Washing with water | 3 min. 15 sec. |
| Fixing | 6 min. 30 sec. |
| Washing with water | 3 min. 15 sec. |
| Stabilizing | 1 min. 30 sec. |
| Drying | |

The treating solutions employed in respective treatment steps are as follows:

| | |
|---|---|
| Composition of color forming developing solution | |
| 4-Amino-3-methyl-N—ethyl-N—(β-hydroxyethyl)-aniline sulfate | 4.8 g |
| Anhydrous sodium sulfite | 0.14 g |
| Hydroxyamine·½sulfate | 1.98 g |
| Sulfuric acid | 0.74 mg |
| Anhydrous potassium carbonate | 28.85 g |
| Anhydrous potassium hydrogen carbonate | 3.46 g |
| Anhydrous potassium sulfite | 5.10 g |
| Potassium bromide | 1.16 g |
| Sodium chloride | 0.14 g |
| Nitrotriacetic acid·3 sodium salt (monohydrate) | 1.20 g |
| Potassium hydroxide | 1.48 g |
| (Make up to one liter by addition of water) | |
| Composition of bleaching solution | |
| Ethylenediaminetetraacetic acid iron (III) ammonium salt | 100.0 g |
| Ethylenediaminetetraacetic acid diammonium salt | 10.0 g |
| Ammonium bromide | 150.0 g |
| Glacial acetic acid | 10.0 ml |
| (Make up to one liter by addition of water, and adjust to pH 6.0 with ammonia water.) | |
| Composition of fixing solution | |
| Ammonium thiosulfate | 175.0 g |
| Anhydrous sodium sulfate | 8.6 g |
| Sodium methasulfite | 2.3 g |
| (Make up to one liter by addition of water, and adjust to pH 6.0 with ammonia water.) | |
| Composition of stabilizing solution | |
| Formalin (37% aqueous solution) | 1.5 ml |
| Konidax (produced by Konishiroku Photo | 7.5 ml |

-continued

Industry Co.)
(Make up to one liter by addition of water.)

The results of sensitometry for the magenta images of the samples obtained are shown in Table 2.

The sensitivity is shown in terms of a relative value of a reciprocal number of an exposure dosage for obtaining a density of a fogging density+0.1, relative to the sensitivity of Sample 1 as 100. Gamma-1 shows the tangent of an angle formed by the straight line, connecting the density 0.1 and the density 0.4 on a sensitometry curve, and the axis of abscissa.

TABLE 2

| | Sample No. | Relative sensitivity | Gamma-1 | Maximum density |
|---|---|---|---|---|
| Magenta images by exposure to green light | 1 | 100 | 0.83 | 0.51 |
| | 2 | 88 | 0.86 | 1.1 |
| | 3 | 95 | 0.84 | 0.6 |
| | 4 | 125 | 0.83 | 0.5 |
| | 5 | 126 | 0.95 | 0.7 |
| | 6 | 127 | 1.10 | 1.0 |
| Cyan images by exposure to green light | 1 | | | 0.32 |
| | 2 | | | 0.13 |
| | 3 | | | 0.12 |
| | 4 | | | 0.11 |
| | 5 | | | 0.10 |
| | 6 | | | 0.09 |

Separately, each sample was closely contacted with a transparent square wave chart and subjected to exposure by green monochromatic light to a magenta image density of 0.5, followed by the treatment according to the aforesaid treatment steps to obtain a sample having a dye image.

The sample obtained was subjected to measurement by means of Sakura Microdensitometer Model PDM-5 Type AR (produced by Konishiroku Photo Industry Co.) to determine MTF for respective space frequencies.

Table 3 shows MTF values for the above samples at space frequencies of 10/mm and 30/mm.

The RMS graininess at the portion of magenta image density 0.5 in the sample having obtained a wedge image is also shown in Table 3.

TABLE 3

| | MTF | | |
|---|---|---|---|
| Sample No. | 10/mm | 30/mm | RMS |
| 1 | 88 | 40 | 30 |
| 2 | 95 | 57 | 25 |
| 3 | 89 | 45 | 26 |
| 4 | 92 | 50 | 23 |
| 5 | 90 | 50 | 24 |
| 6 | 91 | 49 | 23 |

The Reference example represents the case where a higher sensitivity layer and a lower sensitivity layer with different sensitivities have been combined and which is hence different from the present invention. However, with respect to the influence of a higher sensitivity layer upon a lower sensitivity layer, it shows typically the influence of the higher sensitivity layer according to the present invention upon a lower sensitivity layer. As apparently seen from Table 2 and Table 3, Reference samples (Samples 4 and 5) of which high sensitivity layers satisfy the constitution of the high sensitivity layer of the present invention have little influence on the low sensitivity layer, and excellent in sensitivity and image quality of the high sensitivity layer. This suggests that the high sensitivity layer has little influence on the lower sensitivity layer and has high sensitivity as well as high image quality even in the layer constitution of the present invention.

EXAMPLE 1

According to the following procedures, the first layer and the second layer were successively provided by coating on a support to prepare samples 7 to 18.

First Layer

As a magenta coupler, 15 g of (M-1), and 0.6 g of DIR compound (W-1) were dissolved in 31.2 ml of ethyl acetate and 15.6 ml of TCP, and the resultant solution was mixed with 20 ml of a 10% aqueous solution of Alkanol B (alkylnaphthalene sulfonate, produced by E. I. Du Pont de Nemours & Company) and 200 ml of an aqueous 5% gelatin solution, followed by emulsifying dispersing by means of a colloid mill. The dispersion was added to a low sensitivity green sensitive silver iodobromide emulsion (containing 4.0 mole % of silver iodide) to a content of the magenta coupler (M-1) of 10 mole % based on the silver iodobromide and the mixture was coated on a triacetate base to a silver quantity of 13 mg/dm$^2$ and dried.

Second Layer

Each solution in ethyl acetate and TCP of the compounds according to the present invention and Control compounds as shown in Table 4 was mixed with 60 ml of a 10% aqueous Alkanol B solution and 600 ml of an aqueous 5% gelatin solution, followed by emulsifying dispersing by means of a colloid mill. The dispersion was added to a high sensitivity green sensitive silver iodobromide emulsion (containing 6.0 mole % of silver iodobromide) and the mixture was over-layed by coating on the aforesaid first layer to a silver quantity of 13 mg/dm$^2$. Thus, Samples 7 to 18 were prepared.

TABLE 4

(Additives to the second layer)

| | | |
|---|---|---|
| Sample 7 | M - 1 | 0.025 mole |
| | Ethyl acetate | 44 ml |
| | TCP | 22 ml |
| Sample 8 | M - 1 | 0.05 mole |
| | W - 1 | 0.001 mole |
| | Ethyl acetate | 105 ml |
| | TCP | 35 ml |
| Sample 9 | M - 1 | 0.05 mole |
| | D - 1 | 0.025 mole |
| | Ethyl acetate | 105 ml |
| | TCP | 35 ml |
| Sample 10 | Exemplary compound-1 | 0.03 mole |
| | Ethyl acetate | 60 ml |
| | TCP | 30 ml |
| Sample 11 | Exemplary compound-1 | 0.05 mole |
| | Ethyl acetate | 100 ml |
| | TCP | 50 ml |
| Sample 12 | Exemplary compound-1 | 0.07 mole |
| | Ethyl acetate | 140 ml |
| | TCP | 70 ml |
| Sample 13 | Exemplary compound-7 | 0.03 mole |
| | Ethyl acetate | 62 ml |
| | TCP | 31 ml |
| Sample 14 | Exemplary compound-7 | 0.05 mole |
| | Ethyl acetate | 103 ml |
| | TCP | 52 ml |
| Sample 15 | Exemplary compound-7 | 0.07 mole |
| | Ethyl acetate | 144 ml |
| | TCP | 72 ml |
| Sample 16 | Exemplary compound-20 | 0.03 mole |
| | Ethyl acetate | 62 m |
| | TCP | 31 m |

TABLE 4-continued

| (Additives to the second layer) | | |
|---|---|---|
| Sample 17 | Exemplary compound-20 | 0.05 mole |
| | Ethyl acetate | 103 ml |
| | TCP | 52 ml |
| Sample 18 | Exemplary compound-20 | 0.07 mole |
| | Ethyl acetate | 144 ml |
| | TCP | 72 l |

These samples were exposed through a wedge to a green monochromatic light and subjected to developing treatment similarly as described in Reference example 1. The results of sensitometry for the images obtained are shown in Table 5. Separately, each sample was closely contacted with a transparent square wave chart and subjected to exposure by green monochromatic light to a magenta image density of 1.0, followed by the development similarly as in Reference example 1 and measurement of RMS and MTF, to obtain the results as shown in Table 5. Here, Gamma-1 shows the tangent of an angle formed by the straight line, connecting the density 0.1 and the density 0.4 on a sensitometry curve, and the axis of abscissa; Gamma-2 shows the tangent of an angle formed by the straight line, connecting the density 0.75 and the density 1.05 on a sensitometry curve, and the axis of abscissa; and Gamma-3 shows the tangent of an angle formed by the straight line, connecting the density 1.5 and the density 1.8 on a sensitometry curve, and the axis of abscissa. The relative sensitivity is shown as a value relative to the sensitivity of Sample 7 as 100.

TABLE 5

| Sample No. | Relative sensitivity | Gamma-1 | Gamma-2 | Gamma-3 | MTF 10/mm | MTF 30/mm | RMS graininess |
|---|---|---|---|---|---|---|---|
| 7 | 100 | 0.85 | 0.86 | 0.86 | 88 | 61 | 42 |
| 8 | 90 | 0.86 | 1.0 | 0.89 | 97 | 72 | 38 |
| 9 | 96 | 0.85 | 1.05 | 0.90 | 89 | 64 | 40 |
| 10 | 126 | 0.84 | 0.86 | 0.86 | 95 | 75 | 35 |
| 11 | 125 | 0.93 | 0.90 | 0.87 | 93 | 74 | 34 |
| 12 | 127 | 1.07 | 1.65 | 0.87 | 88 | 64 | 36 |
| 13 | 125 | 0.83 | 0.87 | 0.85 | 96 | 76 | 36 |
| 14 | 128 | 0.94 | 0.91 | 0.86 | 93 | 75 | 35 |
| 15 | 126 | 1.09 | 1.64 | 0.86 | 89 | 63 | 35 |
| 16 | 124 | 0.85 | 0.86 | 0.86 | 94 | 74 | 36 |
| 17 | 125 | 0.92 | 0.90 | 0.87 | 92 | 74 | 37 |
| 18 | 127 | 1.10 | 1.65 | 0.87 | 87 | 67 | 35 |

As apparently seen from Table 5, the Samples 10, 11, 13, 14, 16 and 17 of the present invention have similar values of Gamma-1,2 and 3, indicating broad latitude, and have high sensitivity and high image quality. Between the Samples of the present invention, Sample 10 is superior in linear characteristic to Sample 11, and higher effect can be obtained when the density of the image obtained in the highest sensitivity layer does not exceed 0.6, as suggested by Reference example 1.

EXAMPLE 2

On the first layer as employed in Reference example 1, there was provided as the second layer an emulsion, which had been prepared by mixing each solution as shown in Table 6 with 60 ml of a 10% aqueous Alkanol B solution and 600 ml of a 5% aqueous gelatin solution, followed by emulsifying dispersing by means of a colloid mill, and then adding the dispersion to a high sensitivity red sensitive silver iodobromide emulsion (silver iodobromide with 6.0 mole % of silver iodide) containing one mole of silver iodobromide, to a silver content coated of 13 mg/dm$^2$. Thus, Samples 19 to 30 were prepared.

TABLE 6

| (Additives to the second layer) | | |
|---|---|---|
| Sample 19 | C - 1 | 0.025 mole |
| | Ethyl acetate | 44 ml |
| | TCP | 22 ml |
| Sample 20 | C - 1 | 0.05 mole |
| | W - 1 | 0.001 mole |
| | Ethyl acetate | 105 ml |
| | TCP | 35 ml |
| Sample 21 | C - 1 | 0.05 mole |
| | D - 1 | 0.025 mole |
| | Ethyl acetate | 105 ml |
| | TCP | 35 ml |
| Sample 22 | Exemplary compound-12 | 0.03 mole |
| | Ethyl acetate | 58 ml |
| | TCP | 30 ml |
| Sample 23 | Exemplary compound-12 | 0.05 mole |
| | Ethyl acetate | 97 ml |
| | TCP | 48 ml |
| Sample 24 | Exemplary compound-12 | 0.07 mole |
| | Ethyl acetate | 135 ml |
| | TCP | 68 ml |
| Sample 25 | Exemplary compound-18 | 0.03 mole |
| | Ethyl acetate | 56 ml |
| | TCP | 28 ml |
| Sample 26 | Exemplary compound-18 | 0.05 mole |
| | Ethyl acetate | 93 ml |
| | TCP | 47 ml |
| Sample 27 | Exemplary compound-18 | 0.07 mole |
| | Ethyl acetate | 131 ml |
| | TCP | 66 ml |
| Sample 28 | Exemplary compound-27 | 0.03 mole |
| | Ethyl acetate | 60 ml |
| | TCP | 30 ml |
| Sample 29 | Exemplary compound-27 | 0.05 mole |
| | Ethyl acetate | 100 ml |
| | TCP | 50 ml |
| Sample 30 | Exemplary compound-27 | 0.07 mole |
| | Ethyl acetate | 140 ml |
| | TCP | 70 ml |

These samples were exposed through a wedge to a red light and subjected to developing treatment similarly as described in Reference example 1. The results of sensitometry for the images obtained are shown in Table 7. Separately, each sample was closely contacted with a transparent square wave chart and subjected to exposure by red light to a cyan image density of 1.0, followed by the development similarly as in Reference example 1 and measurement of RMS and MTF, to obtain the results as shown in Table 7.

TABLE 7

| Sample No. | Relative sensitivity | Gamma-1 | Gamma-2 | Gamma-3 | MTF 10/mm | MTF 30/mm | RMS graininess |
|---|---|---|---|---|---|---|---|
| 19 | 100 | 0.83 | 0.84 | 0.83 | 86 | 61 | 42 |
| 20 | 90 | 0.88 | 1.15 | 0.84 | 89 | 66 | 40 |
| 21 | 97 | 0.84 | 1.20 | 0.83 | 89 | 65 | 41 |
| 22 | 125 | 0.82 | 0.84 | 0.83 | 94 | 73 | 36 |
| 23 | 123 | 0.91 | 0.86 | 0.85 | 93 | 74 | 35 |
| 24 | 124 | 1.04 | 1.52 | 0.84 | 94 | 74 | 35 |
| 25 | 123 | 0.81 | 0.81 | 0.82 | 92 | 75 | 37 |
| 26 | 126 | 0.92 | 0.88 | 0.84 | 94 | 73 | 35 |
| 27 | 124 | 1.02 | 1.51 | 0.83 | 93 | 74 | 35 |
| 28 | 123 | 0.81 | 0.84 | 0.82 | 93 | 74 | 37 |
| 29 | 122 | 0.90 | 0.87 | 0.85 | 93 | 74 | 36 |
| 30 | 123 | 1.03 | 1.53 | 0.84 | 92 | 75 | 35 |

As apparently seen from Table 7, the Samples 22, 23, 25, 26, 28 and 29 of the present invention have similar values of Gamma-1, 2 and 3, indicating broad latitude, and have high sensitivity and high quality. Between the Samples of the present invention, Sample 21 is superior in linear characteristic to Sample 22.

EXAMPLE 3

Each of Samples 31 to 36 was prepared by providing by coating of the respective layers shown below successively in the order mentioned on a transparent support comprising a cellulose triacetate film on which subbing treatment had been applied (in all of the Examples shown below, the amount added into the light-sensitive silver halide color photographic material is shown in terms of an amount per 1 $m^2$, and the silver halide emulsion and the colloidal silver is shown by calculation as silver).

[Samples 31–35]:

| | |
|---|---|
| Layer 1 | Halation preventive layer containing 0.4 g of black colloidal silver and 3 g of gelatin. |
| Layer 2 | Low sensitivity red sensitive emulsion layer containing 1.4 g of low sensitivity red sensitive silver iodobromide emulsion (AgI: 5 mole %), 1.5 g of gelatin and 0.4 g of TCP having 0.80 g of 1-hydroxy-4-(β-methoxyethyl-aminocarbonylmethoxy),-N—[δ-(2,4-di-t-amylphenoxy)butyl]-2-naphthoamide [hereinafter called as Cyan coupler (C - 2)], 0.025 g of 1-hydroxy-4-[4-(1-hydroxy-8-acetamido-3,6-disulfo-2-naphthylazo)-phenoxy]-N—[δ-(2,4-di-t-amylphenoxy)butyl]-2-naphthoamide disodium [hereinafter called as Colored cyan coupler (CC - 1)] and 0.45 g of DIR compound (W - 1) dissolved therein. |
| Layer 3 | High sensitivity red sensitive emulsion layer containing 1.4 g of high sensitivity red sensitive silver iodobromide emulsion (AgI: 5 mole %), 1.5 g of gelatin and 0.15 g of TCP having 0.23 g of Cyan coupler (C - 1), 0.034 g of Colored cyan coupler (CC - 1) and 0.013 g of DIR compound (W - 1) dissolved therein. |
| Layer 4 | Intermediate layer containing 0.04 g of di-n-butyl phthalate [hereinafter called as DBP] having 0.07 g of 2,5-di-t-octylhydroquinone [hereinafter called as Contamination preventive agent (HQ - 1)] dissolved therein and 1.2 g of gelatin. |
| Layer 5 | Low sensitivity green sensitive emulsion layer containing 1.5 g of a low sensitivity green sensitive silver iodobromide emulsion (AgI: 5 mole %), 1.6 g of gelatin and 0.3 g of TCP having three kinds of couplers of 0.28 of Magenta coupler (M-1), 0.19 g of 4,4-methylenebis-[1-(2,4,6-trichlorophenyl)-3-[3-(2,4-di-t-amylphenoxyacetamido) benzeneamido]-5-pyrazolone [hereinafter called as Magenta coupler (M-2)] and 0.062 g of 1-(2,4,6-trichlorohenyl)-4-(1-naphthylazo)-3-(2-chloro-5-octadecenyl-succinimidoanilino)-5-pyrazolone [hereinafter called as Colored magenta coupler (CM-1)] and 0.02 g of DIR compound (W-1) dissolved therein. |
| Layer 6 | High sensitivity green sensitive emulsion layer containing an emulsified dispersion of 1.5 g of a high sensitivity green sensitive silver iodobromide emulsion (AgI: 5 mole %), 1.9 g of gelatin and a TCP solution as indicated in Table 8. |
| Layer 7 | Yellow filter layer containing 0.2 g of yellow colloidal silver, 0.11 g of DBP having 0.2 g of Contamination preventive agent (HQ-1) dissolved therein and 2.1 g of gelatin. |
| Layer 8 | Low sensitivity blue sensitive emulsion layer containing 1.1 g of a low sensitivity blue sensitive silver iodobromide emulsion (AgI: 5 mole %), 2.1 g of gelatin and 0.93 g of DBP having 1.84 g of α-[4-(1-benzyl-2-phenyl-3,5-dioxo-1,2,4-triazolidinyl)]-α-pivaloyl-2-chloro-5-[γ-(2,4-di-t-amylphenoxy) butaneamido]acetanilide [hereinafter called as Yellow coupler (Y-1)] and 0.82 g of DIR compound (W-1) dissolved therein. |
| Layer 9 | High sensitivity blue sensitive emulsion layer containing 1.1 g of high sensitivity blue sensitive silver iodobromide emulsion (AgI: 5 mole %), 2.0 g of gelatin and 0.23 g of DBP containing 0.42 g of Yellow coupler (Y-1) and 0.20 g of DIR compound (W-1) dissolved therein. |
| Layer 10 | Protective layer containing 2.3 g of gelatin. |

TABLE 8

(Composition of TCP solution employed in Layer 6 of each Sample; amount added per one mole of silver halide)

| | | |
|---|---|---|
| Sample 31 | M - 1 | 0.02 mole |
| | M - 2 | 0.01 mole |
| | Ethyl acetate | 54 ml |
| | TCP | 27 ml |
| Sample 32 | M - 1 | 0.04 mole |
| | M - 2 | 0.02 mole |
| | W - 1 | 0.002 mole |
| | Ethyl acetate | 108 ml |
| | TCP | 54 ml |
| Sample 33 | M - 1 | 0.03 mole |
| | M - 2 | 0.015 mole |
| | D - 1 | 0.015 mole |
| | Ethyl acetate | 81 ml |
| | TCP | 41 ml |
| Sample 34 | Exemplary compound-8 | 0.03 mole |
| | Ethyl acetate | 52 ml |
| | TCP | 29 ml |
| Sample 35 | Exemplary compound-8 | 0.05 mole |
| | Ethyl acetate | 87 ml |
| | TCP | 44 ml |
| Sample 36 | Exemplary compound-8 | 0.07 mole |
| | Ethyl acetate | 121 ml |
| | TCP | 60 ml |

These samples were exposed through a wedge to a green light and subjected to developing treatment similarly as described in Reference example 1. The results of sensitometry for the images obtained are shown in Table 9. Separately, each sample was closely contacted with a transparent square wave chart and subjected to exposure by green light to a magenta image density of 1.0, followed by the development similarly as in Reference example 1 and measurement of RMS and MTF, to obtain the results as shown in Table 9.

TABLE 9

| Sample No. | Relative sensitivity | Gamma-1 | Gamma-2 | Gamma-3 | MTF 10/mm | MTF 30/mm | RMS Graininess |
|---|---|---|---|---|---|---|---|
| 31 | 100 | 0.75 | 0.76 | 0.76 | 75 | 45 | 56 |
| 32 | 85 | 0.70 | 1.18 | 0.78 | 87 | 55 | 50 |
| 33 | 90 | 0.74 | 1.20 | 0.82 | 82 | 50 | 53 |
| 34 | 115 | 0.76 | 0.77 | 0.78 | 85 | 53 | 48 |
| 35 | 120 | 0.75 | 0.78 | 0.90 | 84 | 54 | 49 |
| 36 | 120 | 1.05 | 1.55 | 0.77 | 86 | 52 | 48 |

As apparently seen from Table 9, even in sensitive materials comprising a plurality of layers with different color sensitivities, the Samples 34 and 35 of the present invention have similar values of Gamma-1, 2 and 3, indicating broad latitude, and have high sensitivity and high image quality.

We claim:

1. A light-sensitive silver halide color photographic material, comprising a color sensitive layer containing a plurality of silver halide emulsion layers, said plurality of emulsion layers consisting of at least two silver halide emulsion layers having different sensitivities to light, the layer having the highest sensitivity containing at least one compound having a non-diffusion type coupler component and a scavenger component for reaction with an oxidized product of a color forming developing agent, the amount of said compound being 1 to 5 mole % per mole of the silver halide in the layer of highest sensitivity containing said compound.

2. The light-sensitive silver halide color photographic material of claim 1, wherein the layer having the highest sensitivity has an image density of 0.2 to 0.6 after color development treatment.

3. A light-sensitive silver halide color photographic material, comprising a blue sensitive layer, a green sensitive layer and a red sensitive layer, at least one of said layers consisting of at least two silver halide emulsion layers having different sensitivities to light, the layer having the highest sensitivity containing at least one compound having a non-diffusion type couler component and a scavenger component for reaction with an oxidized product of a color forming developing agent, the amount of said compound being 1 to 5 mole % per mole of the silver halide in the layer of highest sensitivity containing said compound.

4. The light-sensitive silver halide color photographic material of claim 3, wherein the layer having the highest sensitivity has an image density of 0.2 to 0.6 after color development treatment.

5. The light-sensitive silver halide color photographic material of claim 1, wherein said compound has the formula:

```
non-diffusion type coupler component
              |
             CH—R
              |
Scavenger Component
```

wherein R is selected from the group consisting of a hydrogen atom, an alkyl group and a phenyl group; said non-diffusion type coupler component is a residual group of a non-diffusion type coupler capable of forming a non-diffusion type color forming dye through a coupling reaction with an oxidized product of a color forming developing agent, wherein a hydrogen atom at the active site of said non-diffusion type coupler is eliminated; and said Scavenger Component is a residual group of a coupler capable of forming a diffusion-type color forming dye or a non-coloring compound which absorbs substantially no light in the visible region, wherein a hydrogen atom at the active site of said coupler is eliminated.

6. The light-sensitive silver halide color photographic material of claim 1, wherein said compound has the formula:

```
non-diffusion type coupler component
              |
Scavenger component
```

wherein the non-diffusion type coupler component is a residual group of a non-diffusion type coupler capable of forming a non-diffusion type color forming dye through a coupling reaction with an oxidized product of a color forming developing agent, wherein a hydrogen atom at a non-active site of said non-diffusion type coupler is eliminated; and said Scavenger component is a residual group of a coupler capable of forming a diffusion-type color forming dye or a non-coloring compound which absorbs substantially no light in the visible region, wherein a hydrogen atom at the active site of said coupler is eliminated.

7. The light-sensitive silver halide color photographic material of claim 6, wherein the non-diffusion type coupler component is bonded to said Scavenger component through an oxygen atom or a nitrogen atom of said non-diffusion type coupler component.

8. The light-sensitive silver halide color photographic material of claim 1, wherein said compound has the formula:

```
non-diffusion type coupler component
              |
Scavenger component
```

wherein said non-diffusion type coupler component is a residual group of a non-diffusion type coupler capable of forming a non-diffusion type color forming dye through a coupling reaction with an oxidized product of a color forming developing agent, wherein a hydrogen atom at the active site of said non-diffusion type coupler is eliminated; and said scavenger component is a residual group of a coupler, capable of forming a diffusion-type color forming dye or a non-coloring compound absorbing substantially no light in the visible region, wherein a hydrogen atom at a non-active site of said coupler is eliminated.

9. The light-sensitive silver halide color photographic material of claim 8, wherein the non-diffusion type coupler component is bonded to said Scavenger component through an oxygen atom or a nitrogen atom of said non-diffusion type coupler component.

10. The light-sensitive silver halide color photographic material of claim 1, wherein said compound has the formula:

```
non-diffusion type coupler component
              |
ED - component
```

wherein said non-diffusion type coupler component is a residual group of a non-diffusion type coupler capable of forming a non-diffusion type color forming dye through a coupling reaction with an oxidized product of a color forming developing agent, wherein a hydrogen atom at the active site of said non-diffusion type coupler is eliminated; and said ED-component is a residual group of a compound, capable of undergoing a cross oxidation reaction with an oxidized product of a color forming developing agent, wherein a hydrogen atom of said compound which produces said ED-component is eliminated; and wherein the ED-component becomes an active Scavenger component upon cleavage of the linkage between the ED-component and the non-diffusion type coupler component when the non-diffusion type coupler component undergoes a coupling reaction with an oxidized product of a color forming developing agent.

* * * * *